United States Patent [19]

Bishop

[11] Patent Number: 4,676,861

[45] Date of Patent: Jun. 30, 1987

[54] BACKING FREE CORRECTION TAPE AND DISPENSER

[75] Inventor: Willis E. Bishop, Diamond Bar, Calif.

[73] Assignee: Avery International Corp., Pasadena, Calif.

[21] Appl. No.: 884,385

[22] Filed: Jul. 11, 1986

[51] Int. Cl.[4] ..... B26F 3/02; B65D 85/672

[52] U.S. Cl. ..... 156/527; 156/577; 156/584; 206/409; 206/411; 221/70; 225/49

[58] Field of Search ..... 156/344, 523, 527, 577, 156/584; 225/48, 49; 206/409, 411; 221/25, 70, 73

[56] References Cited

U.S. PATENT DOCUMENTS

| | | | |
|---|---|---|---|
| 2,373,092 | 4/1945 | Avery | 225/48 |
| 3,913,786 | 10/1975 | Kartasuk | 206/409 |
| 4,336,097 | 6/1982 | Van Kampen et al. | 156/579 |
| 4,396,455 | 8/1983 | Uchida | 156/577 |
| 4,447,482 | 5/1984 | Heinzelman et al. | 156/584 |

FOREIGN PATENT DOCUMENTS

| | | | |
|---|---|---|---|
| 828383 | 2/1960 | United Kingdom | 206/411 |

*Primary Examiner*—Michael Wityshyn

*Attorney, Agent, or Firm*—Poms, Smith, Lande & Rose

[57] ABSTRACT

A pressure sensitive adhesive tape, such as a white typing correction tape, is wound up with backing tape or a liner tape wound between successive turns of the tape. The backing tape is cut into short lengths, and the correction tape is bent sharply back upon itself over a "peeling" member as it is dispensed, to separate the short lengths of the backing or liner tape and leave them behind in the carton. The space within the standard size dispenser package is adequate to hold the waste pieces of backing tape as the correction tape roll is used up. A short cutting blade may be provided to cut off desired lengths of the correction tape.

20 Claims, 8 Drawing Figures

BACKING FREE CORRECTION TAPE AND DISPENSER

FIELD OF THE INVENTION

This invention relates to packages for pressure sensitive adhesive tape which is wound with a liner or backing tape to separate successive layers of the adhesive tape.

BACKGROUND OF THE INVENTION

Commercially available packages of self-adhesive tape, such as correction tape, are normally sold in small cardboard packages containing a roll of the correction tape, wound up with a backing tape or liner to separate adjacent turns of the correction tape. The two tapes are normally separated as the backing tape is pulled out of the package, and a small metal blade is sometimes provided to cut off the desired length of correction tape. The liner or backing tape must also be disposed of, and it is normally periodically cut off or torn off and thrown away.

It is more convenient not to have to bother with disposing of the backing or liner tape, and certain arrangements have been prepared for separately winding this tape up, as shown, for example, in U.S. Pat. Nos. 4,336,097 and 4,447,482. However, these patents require special dispensers which are relatively bulky as they include separate storage space for the waste backing, and this additional space may be more than that required for the unused roll of correction tape and liner or backing tape. There is also a tendency for the backing tape or liner to jam after some portion of the tape has been dispensed, in this type of device.

Accordingly, an important object of the present invention is to provide a dispenser for pressure sensitive adhesive tape, such as correction tape, which is wound with a liner or backing tape, in which the package is no larger than the standard commercially available packages of such tape, but wherein the correction tape is dispensed by itself, and the liner or backing tape is retained within the package.

SUMMARY OF THE INVENTION

In accordance with the present invention, the foregoing object is achieved by cutting the backing tape or liner into short lengths, while still attached to the pressure sensitive adhesive coated tape, and providing a "peeling" arrangement just within the dispensing package, at the point where the correction tape is fed out of the package, to bend the continuous correction tape sharply back upon itself, thereby separating successive short lengths of the backing tape or liner from the correction tape, and leaving these short lengths of backing tape or liner within the package. Further, as the correction tape is dispensed, the original roll becomes smaller, and there is adequate space for the waste pieces of liner or backing tape within the package. A cutting member may be provided at a corner of the dispensing package to cut off desired lengths of the correction tape.

In accordance with a subordinate feature of the invention, the "peeling" arrangement may be implemented by tabs formed from the sides of the dispenser package folded over the dispensing end of the package to not only close this end of the package but also to provide the exit opening for the pressure sensitive tape and guide the tape to accomplish the "peeling" off and separation of the backing tape segments from the pressure sensitive adhesive coated tape.

Advantages of the new design include the following:

1. Avoiding the need to dispose of the backing tape or liner which normally comes out of the dispensing packages with the correction tape.

2. The use of simple cardboard dispensing packages of the same size as those which have been used heretofore.

3. Avoiding the need for special over-size plastic dispensers with separate spaces provided to (a) store the original double wound tape, and (b) to receive the waste roll of backing strip or liner.

Other objects, features, and advantages of the invention will become apparent from a consideration of the following detailed description and from the accompanying drawings.

DETAILED DESCRIPTION OF A PREFERRED EMBODIMENT

Figure 1:
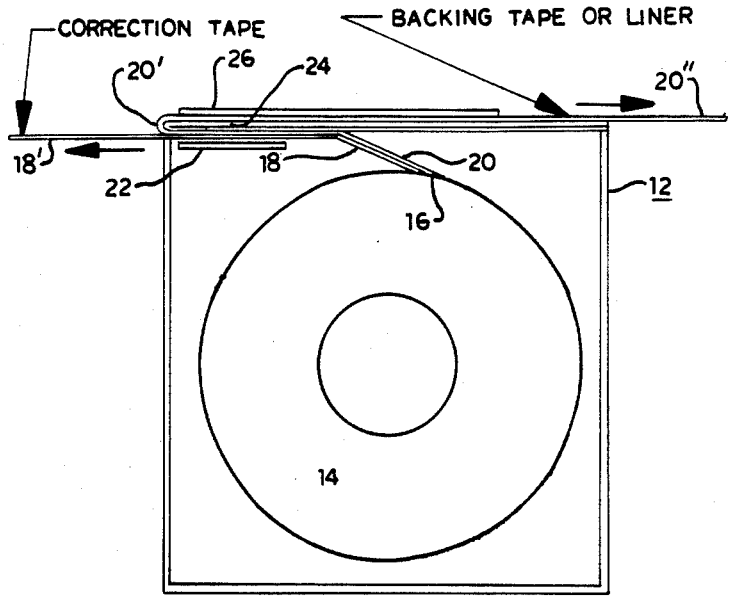
PRIOR ART FIG. 1
FIG. 1 is a diagrammatic side view of a prior art dispenser package for typewriter correction tape in which the tape is wound with a backing tape to protect the pressure sensitive adhesive coating.

Referring more particularly to the drawings, FIG. 1 is a diagrammatic showing of a prior art dispenser package or box 12 containing a dual layer roll 14 of pressure sensitive adhesive coated correction tape wound with a protective backing tape. In accordance with normal practice, the backing tape is provided with a release coating to prevent strong adhesion of the correction tape to the backing tape. As shown in FIG. 1, as the double tape comes off the roll at point 16, the correction tape 18 is on the bottom, with the pressure sensitive adhesive side up, and the backing tape 20 is on top. Portions of the box are folded back and forth as indicated at 22, 24 and 26, so that the backing tape is bent back sharply on itself at point 20' over the cardboard box member 24, so that the backing tape separates from the correction tape 18' and the backing tape may be pulled free from the carton at point 20''. More specifically, when it is desired to dispense some of the correction tape 18', one pulls on the backing tape 20'', and this advances the tape and dispenses additional correction tape 18'. In due course, lengths of the backing tape 20'' must be cut off and thrown away.

Incidentally, the dispensing box may be provided with a cutting blade immediately below the correction tape, if desired. Alternatively, the correction tape may be merely cut off with a pair of scissors or ripped transversely near the point 20'.

Figure 2:
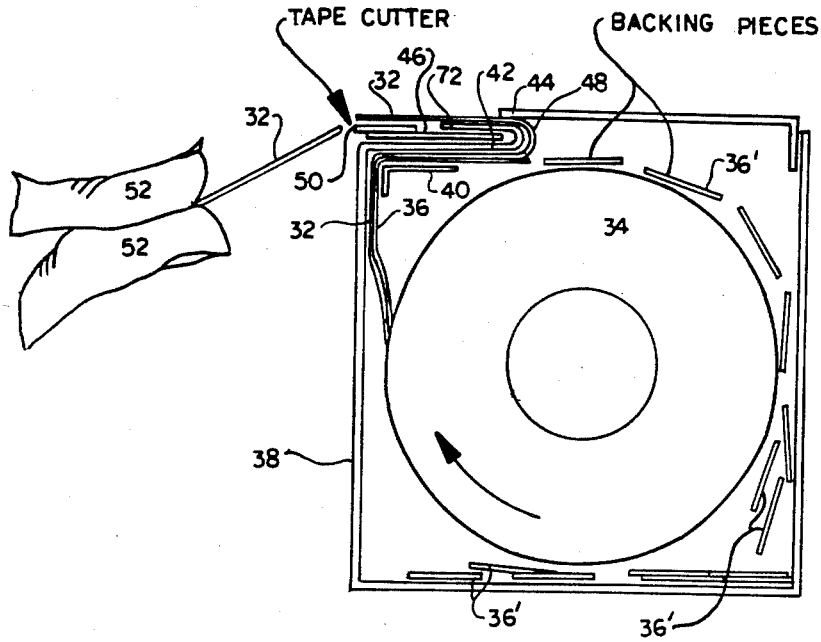
FIG. 2 is a diagrammatic side view of a correction tape and dispenser package for the tape illustrating the principles of this invention, and in which the backing tape is cut into short segments and is retained in the dispensing package.
Figure 2A:
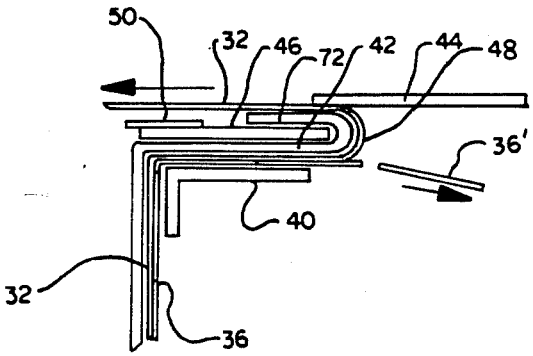
FIG. 2A is an enlarged showing of the upper left-hand corner of FIG. 2.

FIGS. 2 and 2A show a dispenser package illustrating the principles of the present invention. As compared with the prior art dispenser package as shown in FIG. 1, there are several significant differences. For example, in the arrangement of FIG. 1, on the roll 14, the backing tape 20 is on the outside, in each layer, with the backing tape in contact with the self-adhesive or pressure sensitive side of the correction tape 18. In the new arrangement of FIG. 2, however, the roll of correction tape 34 is wound up with the correction tape 32 on the outside and the backing tape 36 being on the inside, and being cut transversely so that the pieces of the backing tape 36' remain within the carton 38 as the tape is being used up. In order to separate the correction tape 32 from the backing tape 36, the double thickness tape 32, 36, as it comes off the roll 34 is constrained by the transverse cardboard member 40, 42, 44 and 46 to follow a path by which the correction tape is turned back sharply upon itself at point 48 so that the pieces of backing tape 36' are separated from the correction tape at point 48, and remain inside the package, as indicated hereinabove. A serrated cutting blade 50 may be provided at the corner of the package 38 in order to assist in cutting off pieces of the correction tape. In FIG. 2 the fingers 52 are shown gripping a length of correction tape 32 after having severed it by pulling it over the blade 50.

Incidentally, in FIGS. 2 and 2A, the layers of cardboard are shown substantially thicker than actual scale. In actuality, contrary to the showing in these figures, the tape 32 is bent sharply back on itself at point 48 to separate the sections 36' of the backing tape.

Figure 3:
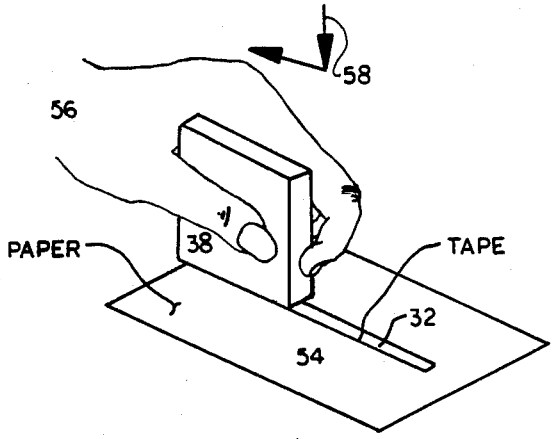
FIG. 3 illustrates one mode of dispensing the correction tape from the package of FIG. 2.

FIG. 3 is a diagrammatic showing of an alternate mode of dispensing the tape 32 from the package 38 by turning the package over and applying the tape 32 directly to a sheet of paper 54 by a pressing and pulling action by the hand 56, as indicated by the arrows 58. Thus, the tape 32 may be dispensed either by directly pulling a section of tape out from the box 38 and cutting it off across the cutting blade 50 or it may be dispensed by turning the dispenser box 38 upside-down and engaging the sticky side of the tape 32 with the paper to which the correction tape is to be applied, thereby applying it directly from the box to the paper.

Figure 4:
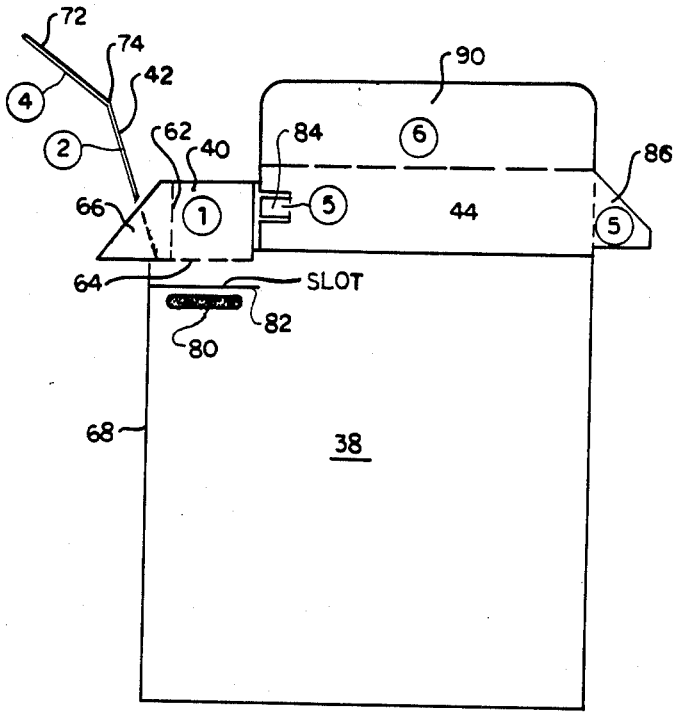
FIGS. 4 and 5 are front and back views of the dispenser carton of FIG. 2, showing the top of the package before it is fully assembled into the configuration as shown in FIG. 2.
Figure 5:
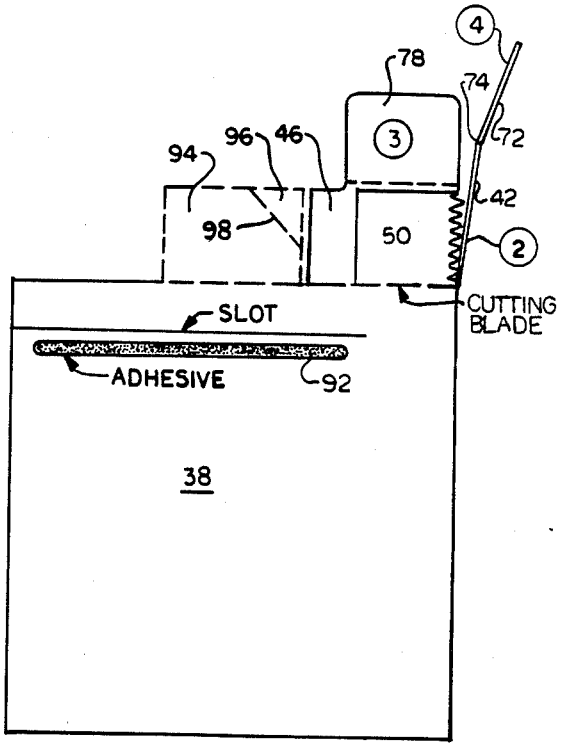

FIGS. 4 and 5 are front and rear views of the box 38, with the flaps at the top of the box being extended upwardly. Now, before going into detail, it may be noted that certain numbers from 1 through 6 appear in circles, and these numbers represent the order in which the flaps are folded down or assembled into the top of a box 38.

Going into greater detail, the flap 40 is the first to be folded down. As it must underlie the dual tape 32, 36, as shown in FIG. 2 of the drawings, it is folded about lines 62 and 64 where dashed lines appear. First, the end flap 66 is folded along line 62, and then the flap 40 with end portion 66 now at right angles to the main portion of the tab 40 is folded down along lines 64. Because this fold line 64 is somewhat below the upper surface of the box and because the fold line 62 is somewhat inward from the left-hand side 68 of the box 38, there is space for the double tape 32, 36 to extend upwardly from the roll 34 around the tab 40, as shown in FIG. 2 of the drawings. Further, the downwardly extending tab 66 will provide resistance to any downward pressure on the main horizontal area of the tab 40 as the tape is advanced.

The next step is to fold the upwardly extending flap 42 downward, leaving the end portion 72 bent at approximately 90 degrees relative to flap 42 at the fold line 74. Then, referring to FIG. 5, the flap 46 has its outer portion 78 folded down over the outside of the box 38 where it is secured to the outside of the box by the adhesive 80. Alternatively, if the box has already been re-opened, the outer tab 78 may be inserted through slot 82 (see FIG. 4) as an alternative mode of holding it in place. The end flap 72 is then folded back toward the upper left corner of the box 38, as shown in FIG. 4, to provide a smooth durable edge of increased thickness over which the correction tape may slide, as it folds back upon itself. At this point, the two small flaps 84 and 86 are folded inwardly, into the paper as shown in Fig. 4, and the large flap 44 including the upper portion 90 is folded down over the outer back side of the box 38 and is held in position by the band adhesive 92 (see Fig. 5). In addition, the left-hand end of the flap 44 overlies the folded corner 74 associated with flaps 42 and 72 to more sharply fold the correction tape back onto itself, to ensure peeling off of the backing pieces 36'.

Now, with reference to FIG. 5, an alternative arrangement for serving the function of the tab 84 is indicated in dashed lines by the flap 94 with the corner 96 which may be folded down along the fold line 98 to more positively separate the pieces 36' of the backing tape, a function that was accomplished by the flap 84 in the showing of FIG. 4. When the flap 94, 96 is employed, particularly for narrower correction tape packages, the flap 84 need not be present.

Figure 6:
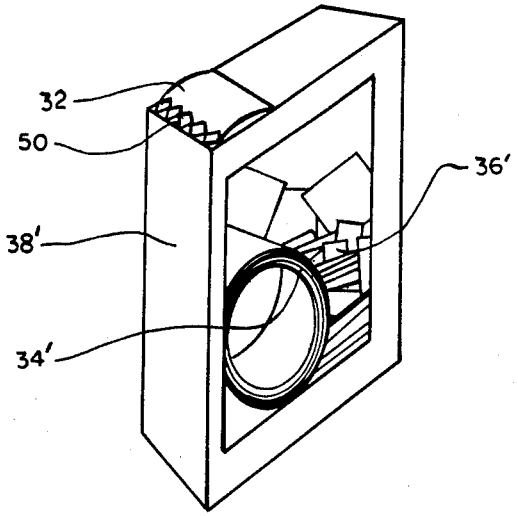
FIG. 6 is an isometric view of a tape dispenser illustrating the principles of the present invention wherein one side of the enclosing box is transparent and wherein the tape is nearly used up.

FIG. 6 illustrates a package of correction tape which is provided with a transparent side, to more clearly indicate how the package 38' accommodates the many pieces of backing tape 36' when the roll 34' of correction tape and cut backing tape is almost used up. In FIG. 6 the cutting blade 50 and an exposed piece of correction tape 32 with the sticky side up, may clearly be seen.

Figure 7:
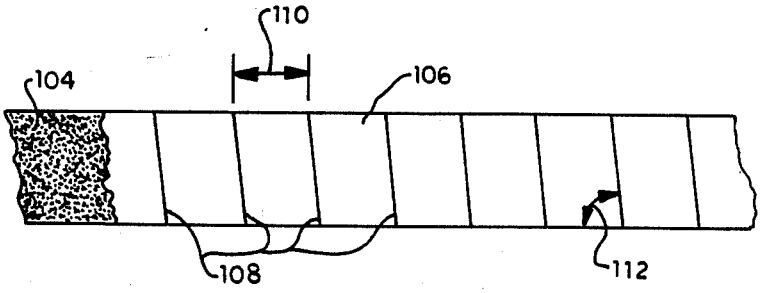
FIG. 7 is a plan view of a short length of tape which may be employed in the implementation of the present invention, and showing the backing tape with a series of transverse cuts to permit retention of the pieces of backing tape within the dispensing packages.

FIG. 7 shows a piece of correction tape 104 to which a backing tape 106 is secured, by the pressure-sensitive adhesive on the mating surface of the correction tape 104, and with the backing tape being initially coated with a conventional release layer. Following assembly of the two tapes, they are passed through a cutting apparatus which cuts the backing tape as indicated at lines 108 but which leaves the correction tape 104 intact. This step may be accomplished by die-cutting or other techniques. Accordingly, as the correction tape is bent sharply back upon itself as it is drawn over the peeling member 42, the pieces of the backing tape 106 are peeled off and remain within the tape package. The spacing 110 between the cuts 108 in the backing and angle 112 of the cuts relative to the edge of the tape, may be varied to suit the particular tape type and the tape width. These two factors will affect the stripping of the backing pieces 36 and 106 from the tapes 32 and 104 and can be optimized for a particular application. It is also noted that the cuts in the backing need not be straight, but may be curved, wavy or in a zigzag configuration.

Incidentally, concerning dimensions, the packages for correction tape are normally three inches square with the boxes for $\frac{1}{8}$ inch tape being about three eighths inch thick, and packages for wider correction tapes being correspondingly thicker.

In conclusion, it is to be understood that the foregoing detailed description and the accompanying drawings relate to one illustrative embodiment of the invention. However, various changes and modifications may be made without departing from the spirit and scope of the invention. Thus, by way of example, and not of limitation, the package for the tape may be held together either by mechanical folding or slots, or by adhesive. If desired, the tape cutting blade may be omitted, and the correction tape may be torn or cut off with a pair of scissors. Further, alternative mechanical arrangements may be provided for guiding the dual tape, and folding the correction tape back on itself to peel off the pieces of the backing tape or liner. For example, the tape may be mounted in a plastic holder if desired, instead of in a cardboard dispensing package, and the peeling and cutting blades could then be implemented by moulded plastic configurations. The present invention may also be applied to tapes other than correction tapes. Accordingly, the present invention is not limited to the construction precisely as shown in the drawings and as described hereinabove.

What is claimed is:

1. A dispenser package assembly of pressure sensitive adhesive tape wound with a liner or backing strip comprising:

a roll of pressure sensitive adhesive tape including a liner or backing strip wound up with said tape, said liner or backing strip being cut into a series of short lengths while still attached to the pressure sensitive adhesive tape;

a dispenser package containing said roll;

said dispenser package including an exit opening for said pressure sensitive adhesive tape; and said dispenser package further including peeling means adjacent said exit opening for sharply bending said pressure sensitive tape back on itself to separate said pressure sensitive adhesive tape from said short lengths of liner or backing strip within the package;

whereby, as said pressure sensitive tape is used up, the waste short lengths of backing strip or liner are held within the package and occupy some of the space previously occupied by the original roll of tape.

2. A dispenser package assembly as defined in claim 1 wherein said pressure sensitive tape is correction tape.

3. A dispenser package assembly as defined in claim 1 wherein blade means are provided at one corner of said dispenser package for cutting said pressure sensitive adhesive tape.

4. A dispenser package assembly as defined in claim 1 wherein said exit opening is located along one side of said dispenser package intermediate the ends thereof, and means are provided for directing the exposed tape along the surface of said side, with the pressure sensitive adhesive coated side of said tape facing away from the package.

5. A dispenser package assembly as defined in claim 1 wherein said peeling means includes means for constraining said pressure sensitive adhesive tape with said liner or backing strip to follow path along the inside of one narrow side of said package which is substantially parallel to the axis of the roll of tape, and said peeling means further includes means for directing the pressure-sensitive tape, free of the pieces of liner or backing strip, back along the outside of the same section of the same narrow side of said package.

6. A dispenser package assembly as defined in claim 1 wherein said peeling means is implemented by tabs from said package folded along one side of said package.

7. A dispenser package assembly as defined in claim 6 wherein said tabs are extensions of three sides of said package folded to form a fourth side thereof.

8. A dispenser package assembly as defined in claim 1 wherein said roll of tape includes a continuous piece of pressure sensitive tape wound up with die cut liner or backing strip and with the pressure sensitive tape wound up outside of said liner or backing strip.

9. A dispenser package assembly as defined in claim 1 wherein said liner or backing strip is cut at an angle to the longitudinal axis of said liner or backing strip.

10. A dispenser package assembly as defined in claim 1 wherein said liner or backing strip is cut with the pieces of liner or backing strip being less than two inches long.

11. A pressure sensitive tape dispenser assembly comprising:

a roll of pressure sensitive adhesive tape including a liner or backing strip wound up with said tape, said liner or backing strip being cut into a series of short lengths while still attached to the pressure sensitive adhesive tape;

a dispenser containing said roll;

said dispenser including an exit opening for said pressure sensitive adhesive tape; and said dispenser further including peeling means adjacent said exit opening for sharply bending said pressure sensitive tape back on itself to separate said pressure sensitive adhesive tape from said short lengths of liner or backing strip within the dispenser;

whereby, as said pressure sensitive tape is used up, the waste short lengths of backing strip or liner are held within the dispenser.

12. A dispenser assembly as defined in claim 11 wherein said pressure sensitive tape is correction tape.

13. A dispenser assembly as defined in claim 11 wherein blade means are provided on said dispenser for cutting said pressure sensitive adhesive tape.

14. A dispenser assembly as defined in claim 11 wherein means are provided for directing the exposed tape out from said dispenser, with the pressure sensitive adhesive coated side of said tape facing away from the package.

15. A dispenser package assembly as defined in claim 11 wherein said roll of tape includes a continuous piece of pressure sensitive tape wound up with die cut liner or backing strip.

16. A dispenser package assembly of pressure sensitive adhesive tape wound with a liner or backing strip comprising:

a roll of pressure sensitive adhesive tape including a liner or backing strip wound up with said tape, said liner or backing strip being cut into a series of short lengths while still attached to the pressure sensitive adhesive tape;

a cardboard carton type dispenser package containing said roll;

said dispenser package including an exit opening for said pressure sensitive adhesive tape;

said dispenser package further including peeling means adjacent said exit opening for sharply bending said pressure sensitive tape back on itself to separate said pressure sensitive adhesive tape from said short lengths of backing tape within the package;

said peeling means including means for constraining said pressure sensitive adhesive tape with said liner or backing strip to follow a path along the inside of one narrow side of said package which is substantially parallel to the axis of the roll of tape, and said peeling means further includes means for directing the pressure-sensitive tape, free of the pieces of liner or backing strip back along the outside of the same section of the same narrow side of said package; and said peeling means being implemented by tabs from said package folded along one side of said package;

whereby, as said pressure sensitive tape is used up, the waste short lengths of backing strip or liner are held within the package and occupy some of the space previously occupied by the original roll of tape.

17. A dispenser package assembly as defined in claim 16 wherein said pressure sensitive tape is correction tape.

18. A dispenser package assembly as defined in claim 16 wherein blade means are provided at one corner of said dispenser package for cutting said pressure sensitive adhesive tape.

19. A dispenser package assembly as defined in claim 16 wherein said exit opening is located along one side of said dispenser package intermediate the ends thereof, and means are provided for directing the exposed tape along the surface of said side, with the pressure sensitive adhesive coated side of said tape facing away from the package.

20. A dispenser package assembly as defined in claim 16 wherein said tabs are extensions of three sides of said package folded to form a fourth side thereof.

* * * * *